US010458323B2

(12) United States Patent
Bucksey

(10) Patent No.: US 10,458,323 B2
(45) Date of Patent: Oct. 29, 2019

(54) INTERNAL COMBUSTION ENGINES

(71) Applicant: Cox Powertrain Limited, London, Greater London (GB)

(72) Inventor: Christian Bucksey, Sussex (GB)

(73) Assignee: COX POWERTRAIN LIMITED, London (GB)

( * ) Notice: Subject to any disclaimer, the term of this patent is extended or adjusted under 35 U.S.C. 154(b) by 0 days.

(21) Appl. No.: 14/368,284

(22) PCT Filed: Dec. 21, 2012

(86) PCT No.: PCT/GB2012/053238
§ 371 (c)(1),
(2) Date: Jun. 23, 2014

(87) PCT Pub. No.: WO2013/093501
PCT Pub. Date: Jun. 27, 2013

(65) Prior Publication Data

US 2015/0027418 A1 Jan. 29, 2015

(30) Foreign Application Priority Data

Dec. 23, 2011 (GB) ..... 1122432.6

(51) Int. Cl.

| | |
|---|---|
| ***F02B 53/02*** | (2006.01) |
| ***F01B 7/04*** | (2006.01) |
| ***F01B 9/02*** | (2006.01) |
| ***F02P 15/04*** | (2006.01) |
| ***F02B 75/28*** | (2006.01) |
| ***F02B 5/00*** | (2006.01) |
| ***F02B 75/24*** | (2006.01) |

(Continued)

(52) U.S. Cl.
CPC ..... *F02B 53/02* (2013.01); *F01B 7/04* (2013.01); *F01B 9/023* (2013.01); *F01B 9/026* (2013.01); *F02B 5/00* (2013.01); *F02B 75/246* (2013.01); *F02B 75/282* (2013.01); *F02P 15/04* (2013.01); *F02B 2075/025* (2013.01); *F02D 2400/04* (2013.01); *F02P 3/02* (2013.01)

(58) Field of Classification Search
CPC ..... F02B 75/28; F01B 7/14; F02F 3/22; F02F 3/12; F01L 11/02
USPC ..... 123/51 R, 53.3, 53.6, 162, 47 R, 65 W, 123/193.6
See application file for complete search history.

(56) References Cited

U.S. PATENT DOCUMENTS

| | | | |
|---|---|---|---|
| 1,270,295 | A | 6/1918 | Husted |
| 2,213,817 | A | 9/1940 | Kinslow |

(Continued)

FOREIGN PATENT DOCUMENTS

| | | |
|---|---|---|
| DE | 3940027 | 8/1990 |
| EP | 2108798 | 10/2009 |

(Continued)

*Primary Examiner* — Lindsay M Low
*Assistant Examiner* — Omar Morales
(74) *Attorney, Agent, or Firm* — Seed IP Law Group LLP

(57) ABSTRACT

An internal combustion engine comprising at least one cylinder and a pair of opposed, reciprocating pistons within the cylinder forming a combustion chamber therebetween. The engine has at least one combustion igniter associated with the cylinder, a portion of the combustion igniter being exposed within the combustion chamber formed between the opposed pistons.

28 Claims, 9 Drawing Sheets

(51) Int. Cl.
*F02P 3/02* (2006.01)
*F02B 75/02* (2006.01)

(56) References Cited

U.S. PATENT DOCUMENTS

| | | | | |
|---|---|---|---|---|
| 7,469,664 | B2 * | 12/2008 | Hofbauer | F02B 1/12 123/54.1 |
| 2004/0159291 | A1 | 8/2004 | Schmied | |
| 2006/0408729 | | 3/2006 | Beshore | |
| 2006/0124084 | A1 * | 6/2006 | Hofbauer | F02B 1/12 123/55.7 |
| 2007/0095320 | A1 | 5/2007 | Warren | |
| 2007/0251496 | A1 * | 11/2007 | Saari | F02B 53/02 123/44 R |
| 2009/0188471 | A1 * | 7/2009 | Jaquet | F01B 3/0005 123/48 B |
| 2009/0314238 | A1 | 12/2009 | Russell | |
| 2010/0192923 | A1 * | 8/2010 | Cox | F01B 1/08 123/51 BC |

FOREIGN PATENT DOCUMENTS

| | | | |
|---|---|---|---|
| JP | 2005009471 | A | 1/2005 |
| TW | 201 037 146 | A | 10/2010 |
| WO | WO98/34012 | | 8/1998 |
| WO | WO2007/010186 | | 1/2007 |
| WO | 2007/094657 | A1 | 8/2007 |
| WO | WO2007/121086 | | 10/2007 |
| WO | 2008/149061 | A2 | 12/2008 |

* cited by examiner

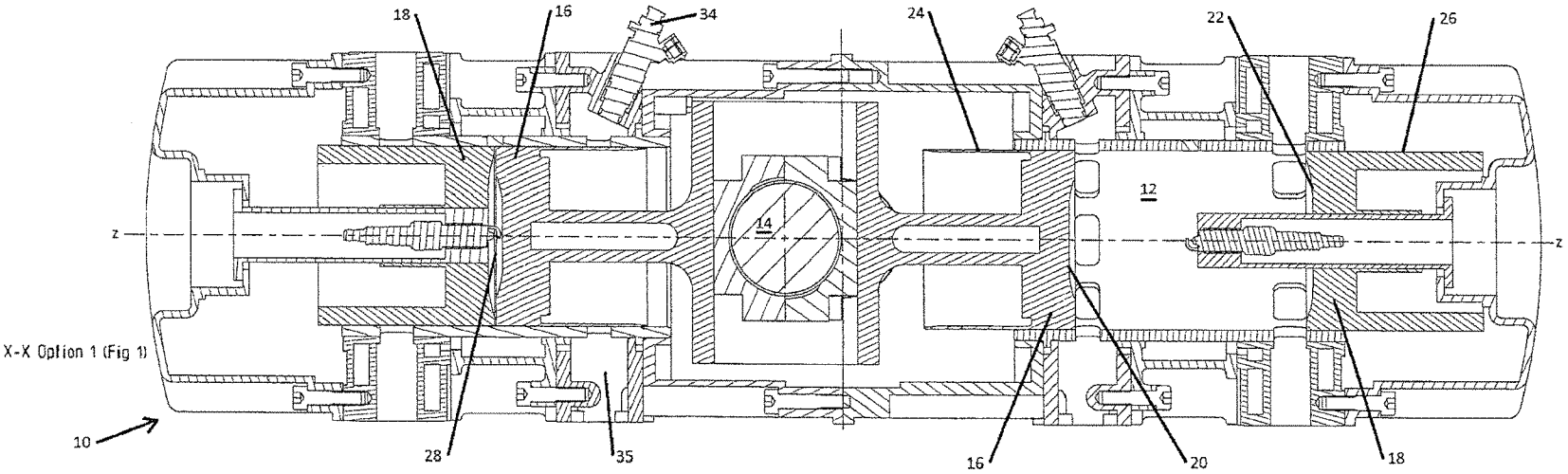
26
22
12
24
34
16
18
18
20
16
14
35
28
10
X-X Option 1 (Fig 1)

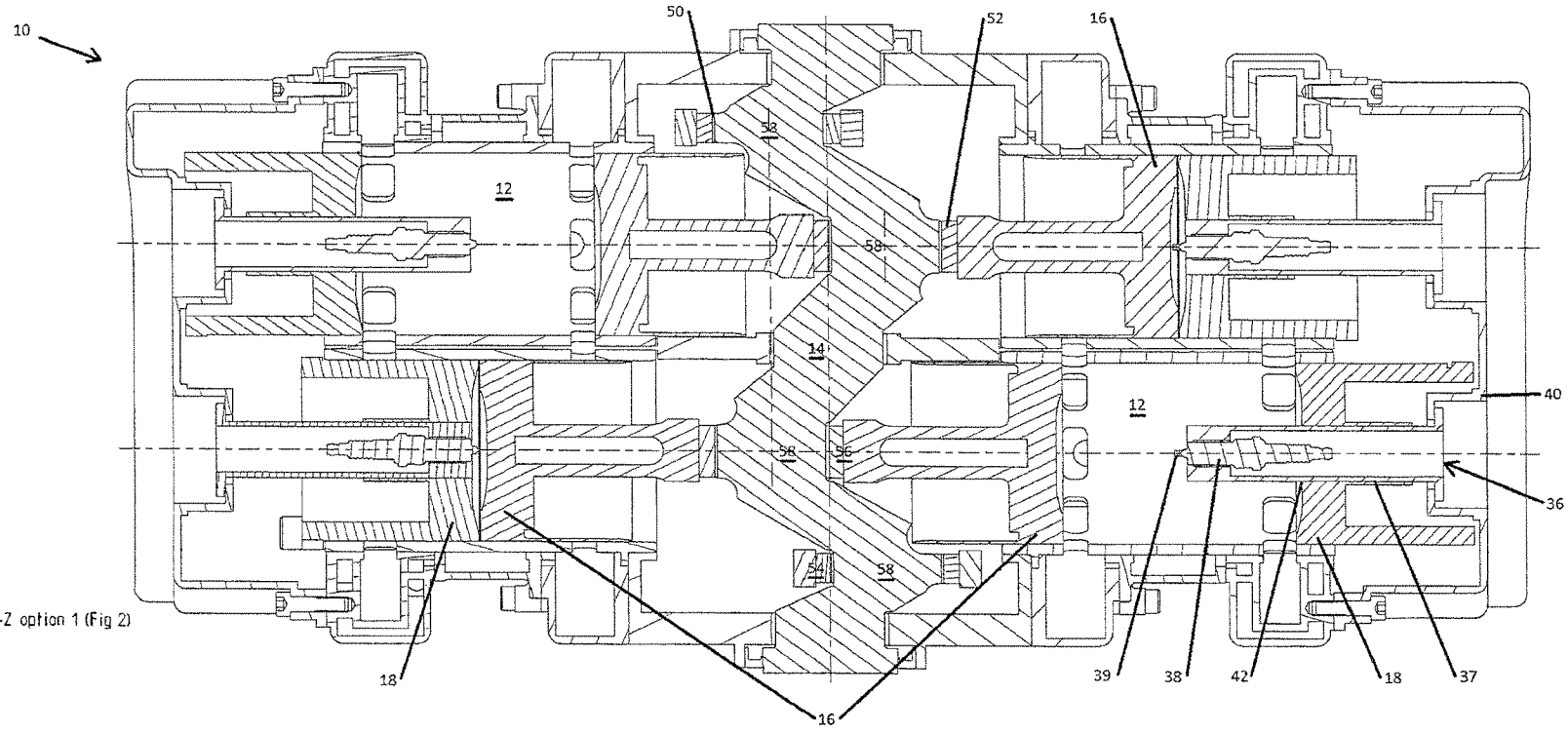
Z-Z option 1 (Fig 2)

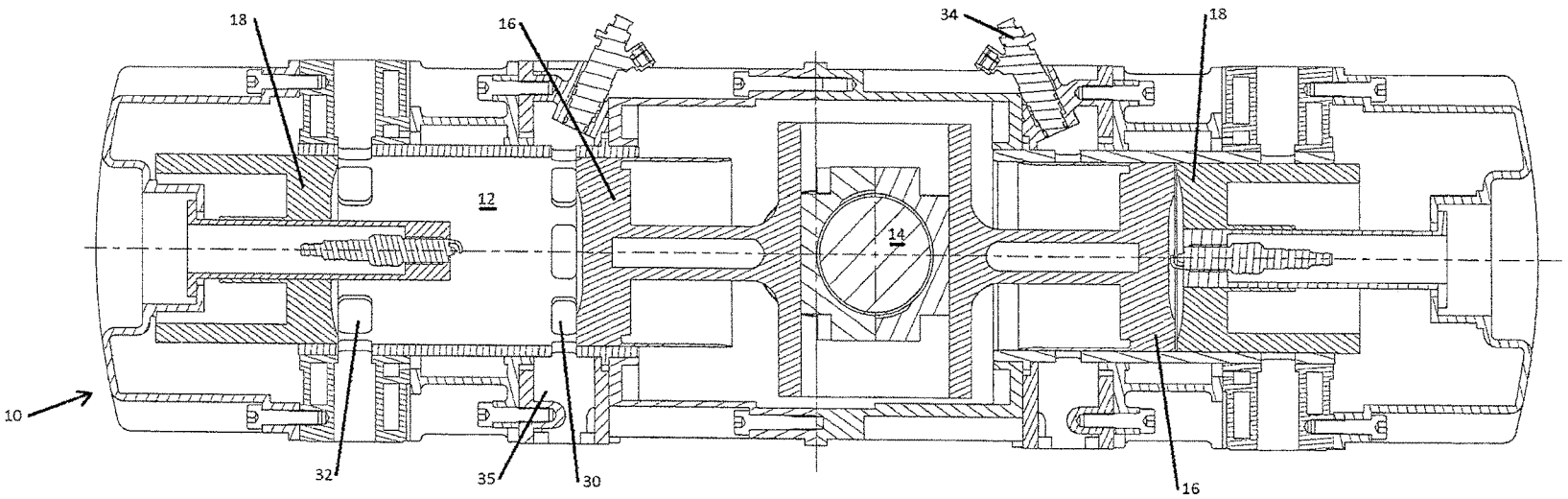
XB2-XB2 Option 1 (Fig 3)

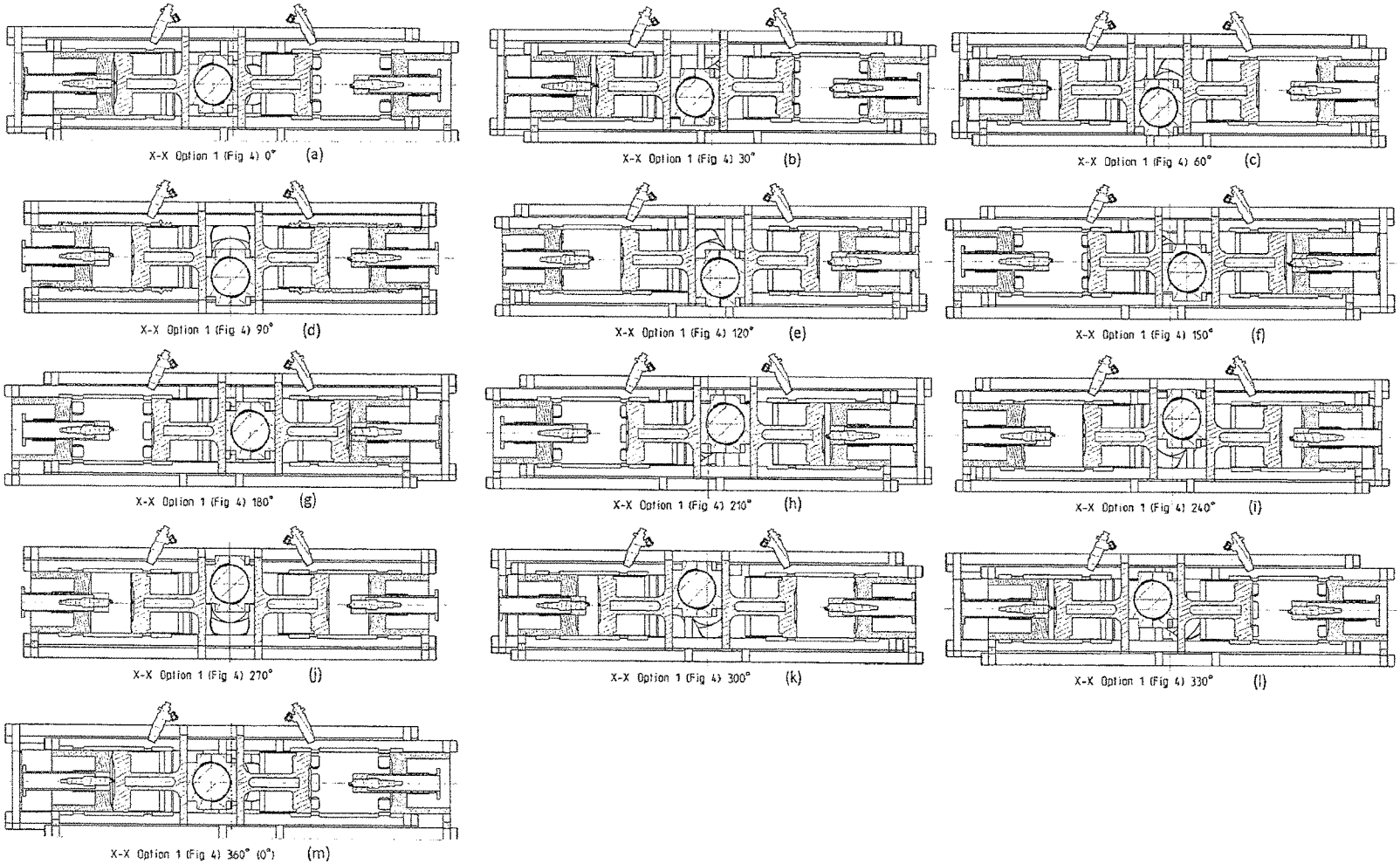
X-X Option 1 (Fig 4) 0° (a)
X-X Option 1 (Fig 4) 30° (b)
X-X Option 1 (Fig 4) 60° (c)
X-X Option 1 (Fig 4) 90° (d)
X-X Option 1 (Fig 4) 120° (e)
X-X Option 1 (Fig 4) 150° (f)
X-X Option 1 (Fig 4) 180° (g)
X-X Option 1 (Fig 4) 210° (h)
X-X Option 1 (Fig 4) 240° (i)
X-X Option 1 (Fig 4) 270° (j)
X-X Option 1 (Fig 4) 300° (k)
X-X Option 1 (Fig 4) 330° (l)
X-X Option 1 (Fig 4) 360° (0°) (m)

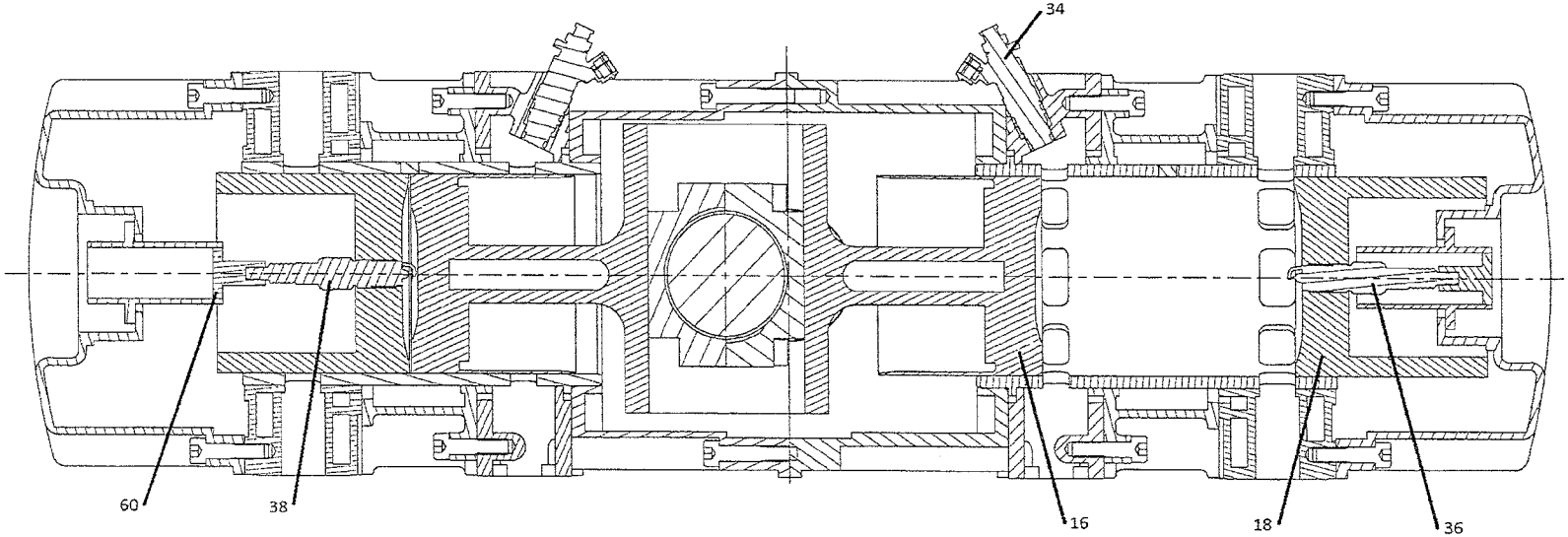
X-X Option 2 (fig 5)

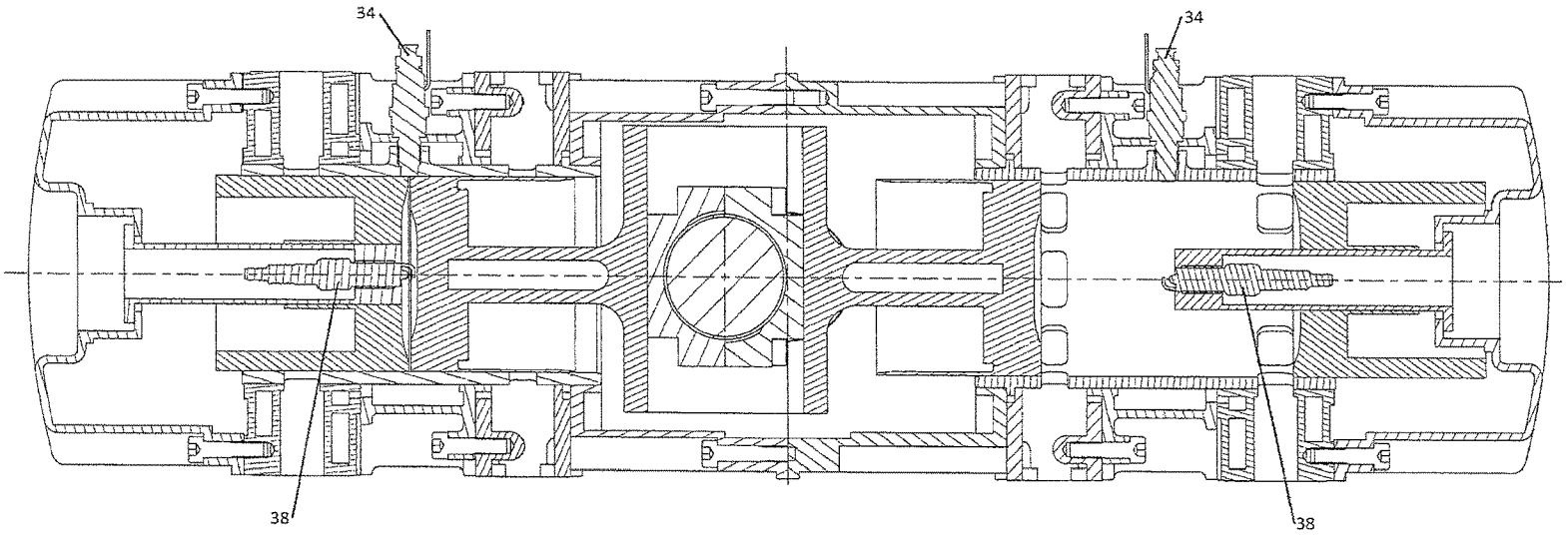
X-X Option 3.1 (fig 6)

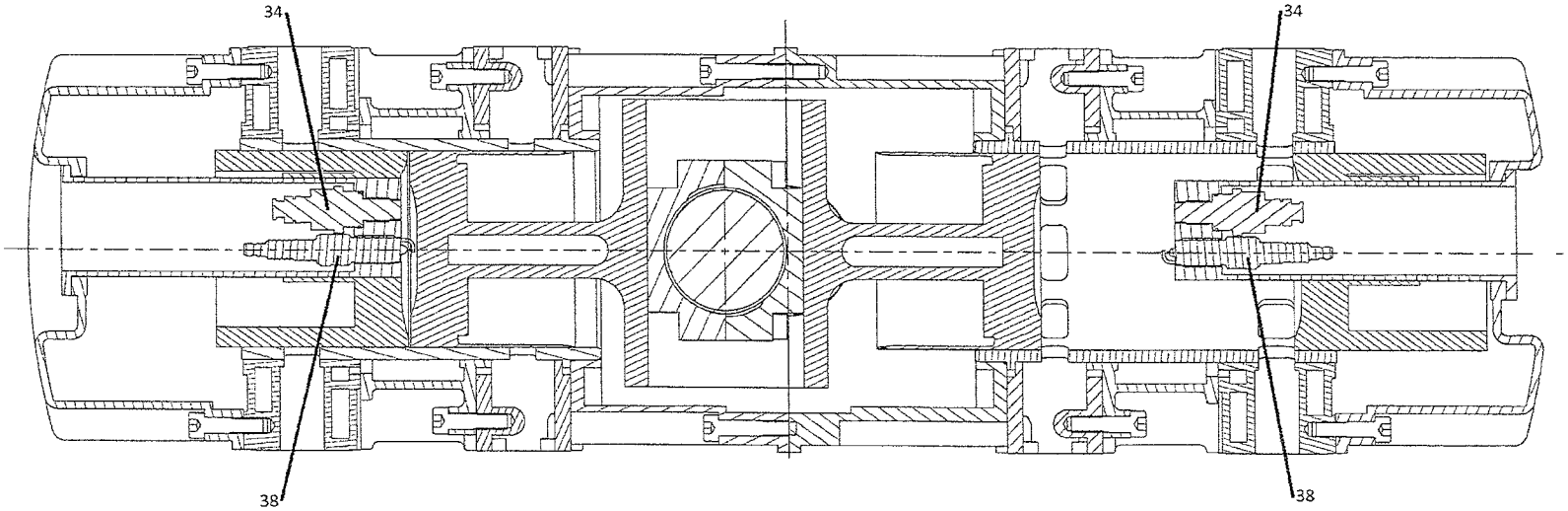
X-X Option 3.2 (fig 7)

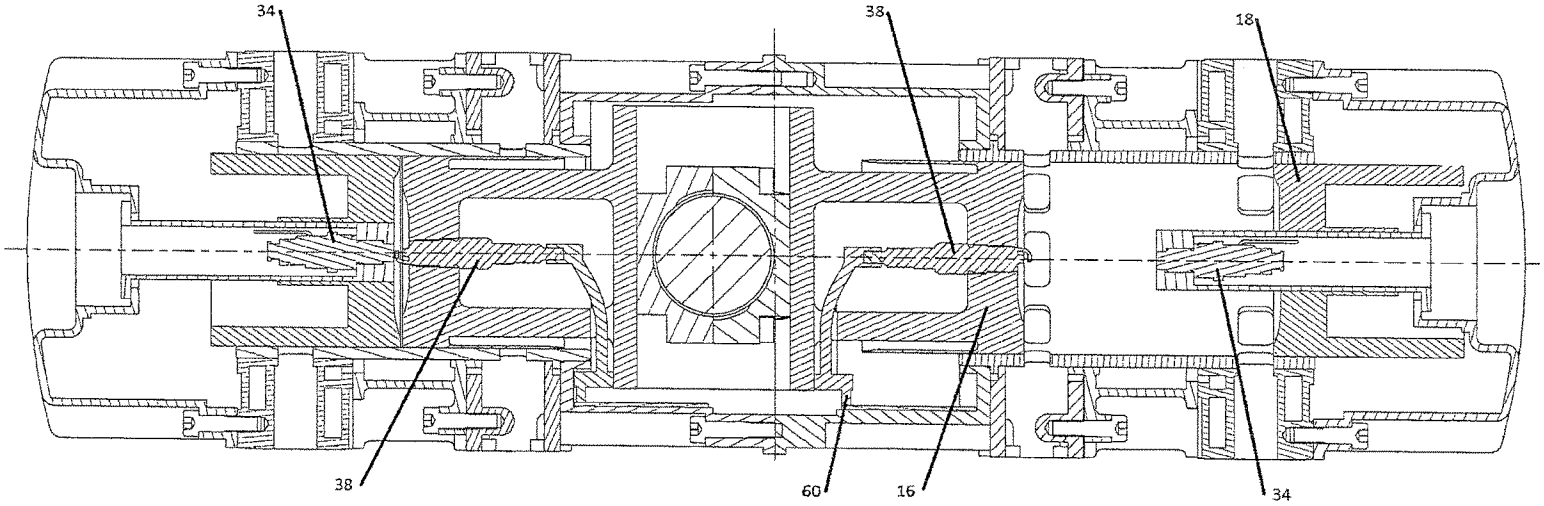
X-X Option 4 (fig 8)

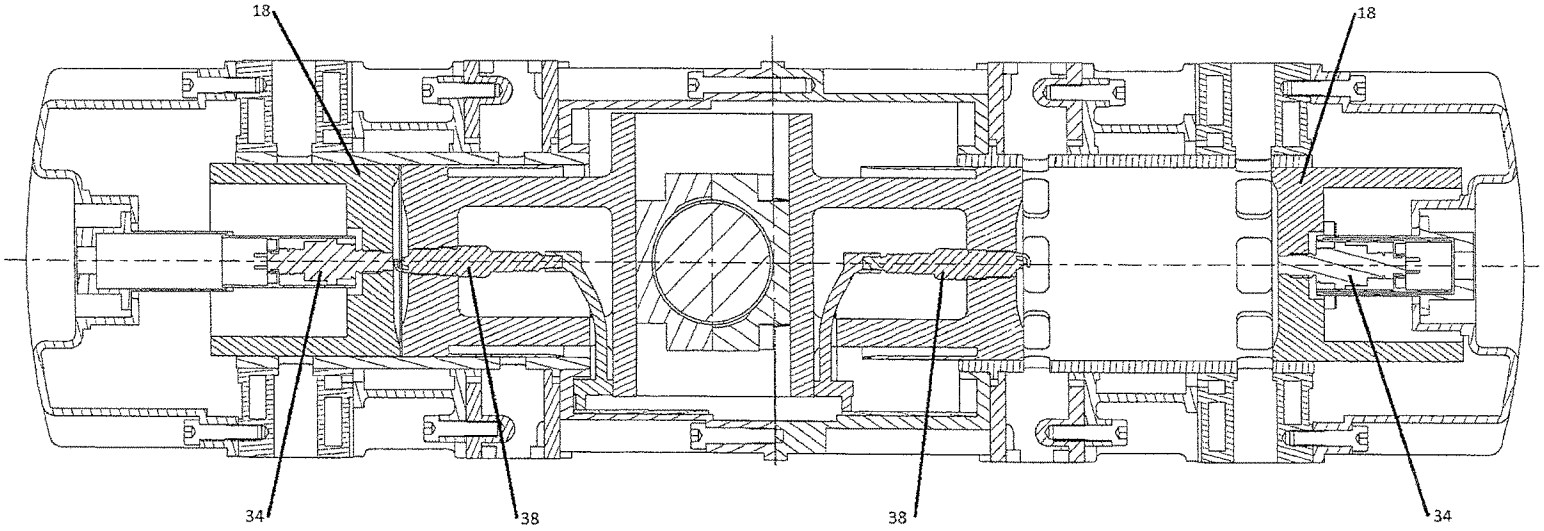
X-X Option 5 (fig 9)

INTERNAL COMBUSTION ENGINES

CROSS-REFERENCE TO RELATED APPLICATIONS

This application claims priority to International Application No. PCT/GB2012/053238, filed Dec. 21, 2012, which claims priority to Great Britain Patent Application No. 1122432.6 filed Dec. 23, 2011, each of which is incorporated by reference in its entirety.

FIELD OF THE INVENTION

This invention relates to internal combustion engines. More particularly it relates to internal combustion engines with an opposed piston configuration.

BACKGROUND

WO2008/149061 (Cox Powertrain) describes a 2-cylinder 2-stroke direct injection internal combustion engine. The two cylinders are horizontally opposed and in each cylinder there are opposed, reciprocating pistons that form a combustion chamber between them. The pistons drive a central crankshaft between the two cylinders. The inner piston (i.e. the piston closer to the crankshaft) in each cylinder drives the crankshaft through a pair of parallel scotch yoke mechanisms. The outer piston in each cylinder drives the crankshaft through a third scotch yoke, nested between the two scotch yoke mechanisms of the inner piston, via a drive rod that passes through the centre of the inner piston. The connecting rod has a hollow tubular form and fuel is injected into the combustion chamber by a fuel injector housed within the connecting rod. The wall of the connecting rod has a series of circumferentially spaced apertures through which the fuel is projected laterally outwardly into the combustion chamber.

SUMMARY OF THE INVENTION

The present invention is generally concerned with opposed piston internal combustion engines having a spark plug in each cylinder to initiate or assist combustion in a combustion chamber formed between the two opposed, reciprocating pistons in the cylinder. In this way it becomes possible to provide "spark ignited" or "spark assisted" variants of an opposed piston engine. This creates opportunities to use a greater variety of fuels to power the engine. The high compression ratios required for compression ignition engines (typically 15:1 or higher) are not necessary for spark ignition engines, where compression ratios of around 10:1 are adequate.

In a first aspect, the present invention provides an internal combustion engine comprising at least one cylinder, a pair of opposed, reciprocating pistons within the cylinder forming a combustion chamber therebetween, and at least one combustion igniter associated with the cylinder, a portion of the combustion igniter being exposed within the combustion chamber formed between the opposed pistons.

The combustion igniter may, for example, be a spark plug, plasma spark generator or a glow plug. For convenience, the combustion igniter is referred to in the following as a "spark plug" but where the context allows this should be taken also to include a plasma spark generator, glow plug or any other suitable means for igniting or assisting ignition of a fuel/air mixture in the cylinder. In the case where the combustion igniter is a spark plug, it will be the electrodes of the spark (at least) that are the portion exposed within the combustion chamber formed between the opposed pistons.

Especially in cases where only a single spark plug is employed, the spark plug is preferably at or close to the central axis of the cylinder/piston. The spark plug electrodes will typically be at one end of the spark plug (the end that projects into the cylinder).

In some embodiments, the spark plug is fixed at one end of the cylinder, typically to a fixed, structural component, and projects into the cylinder from that end, along or parallel to the central axis of the cylinder, to locate the electrodes of the spark plug in a fixed position that is within the combustion chamber throughout the engine cycle. In this case, the spark plug extends through the piston closest to the end of the cylinder from which the spark plug projects and this piston is configured to reciprocate along a housing within which the spark plug is housed.

In an alternative arrangement, the spark plug is fixed to and moves with one of the pistons. In this case, flexible leads, a sliding electrical connection such as brushes or a non-contact electrical connection, e.g. an inductive coupling may be used to provide power to the spark plug.

Typically, the motion of the pistons will drive a crankshaft positioned at one end of the cylinder, the piston closest to the crankshaft end of the cylinder being designated the "inner piston" and the piston furthest from the crankshaft being designated the "outer piston". The or each spark plug may be associated with either the outer piston or the inner piston.

Especially in the case where the spark plug is fixed and the associated (e.g. outer) piston reciprocates along the spark plug housing, the spark plug is preferably cooled. Cooling can be provided, for example, by e.g. air, oil or engine coolant or a combination of these.

In the case where one of the pistons reciprocates on the spark plug housing, the outer surface of the housing preferably provides a running surface along which the piston can slide. A sealing system, for example one or more sealing rings, is provided between the piston and the running surface of the housing to restrict the escape of combustion gases and the ingress of lubricating oil to the combustion chamber.

The spark plug may be fixed directly or indirectly to an outer part of the engine structure by any suitable coupling. Usually the spark plug will be fixed to the spark plug housing and the housing will be fixed to the outer part of the engine structure. In some cases it may be desirable to use a coupling that allows the spark plug housing to self-align itself parallel to the centreline of the cylinder and to accommodate tolerances and thermal distortion of the piston it is associated with. For example, an Oldham coupling may be used (this type of coupling allows the spark plug housing to move in a plane perpendicular to its axis, to allow the desired alignment, whilst preventing movement along its axis).

Embodiments of the invention may be direct injection engines or engine types where the fuel is not injected directly into the cylinder, for example "Port Fuel Injection" or "Manifold Fuel Injection" (referred generally in the following to "indirect injection".

Indirect injection embodiments may be single-point, or multi-point. In single-point indirect injection embodiments, the fuel will typically be injected at a central point within an intake manifold of the engine, from where it is inducted into multiple engine cylinders. In multi-point injection embodiments, on the other hand, one or more fuel injectors associated with each cylinder inject fuel into an intake manifold or runner exposed to intake ports of the cylinder, from where the fuel passes through the intake ports into the cylinder. Transfer port injection is also an option for piston ported engines.

Direct injection embodiments of the invention comprise at least one fuel injector having a nozzle that is directly exposed to the combustion chamber in the cylinder. For instance, the injector(s) may be mounted to the cylinder side-walls. Alternatively, the injector(s) may be mounted at an end of the cylinder, with the injector nozzle protruding through a respective piston crown at that end of the cylinder, into the combustion chamber. In the case where the fuel injector is associated with one of the pistons, similarly to the spark plugs, it may be fixed in position within the cylinder, with the piston sliding around it, or it may be constrained to move with the piston as the piston reciprocates within the cylinder.

The fuel injector may project from the same end or from the opposite end of the cylinder than the spark plug. Where the fuel injector and the spark plug project from the same end of the cylinder they may be contained within a single housing.

In the case where the pistons drive a crankshaft, any suitable drive linkage may be used to translate the opposed reciprocating motion of the pistons into a rotary motion of the crankshaft. In preferred embodiments, however, scotch yoke mechanisms are used. Where scotch yoke mechanisms are used, as a minimum it would be necessary to have at least one scotch yoke through which the inner piston (i.e. the piston closest to the crankshaft) drives the crankshaft and at least one scotch yoke through which the outer piston drives the crankshaft. However, to avoid undesirable unbalanced forces on the outer piston, whilst avoiding the need for a central drive rod through the cylinder, it is more preferable for the outer piston to drive the crankshaft through a pair of scotch yokes, one to either side of the cylinder connected to the outer piston by respective connection members on opposite sides of the cylinder. The connection members may, for example be rods or sleeve portions within the cylinder, at or close to the periphery of the cylinder. More preferably, the connection members are external to the cylinder. They may comprise, for example, one or more drive rods.

Whilst a single cylinder configuration is possible preferred engines in accordance with embodiments of the invention comprise multiple cylinders, for example two cylinders, four cylinders, six cylinders, eight cylinders or more.

Where multiple cylinders are used, various configurations are possible that may offer different benefits in terms of balance of forces, overall shape and size of the engine, etc. Exemplary configurations include (but are not limited to) coaxial opposed pairs of cylinders (e.g. 'flat two', 'flat four', etc), 'straight' configurations with all of the cylinders side-by-side, 'U' configurations with two straight banks of cylinders side-by-side (e.g. 'square 4'), 'V' configurations and 'W' configurations (i.e. two adjacent banks of 'V' configured cylinders) and radial configurations. Depending on the configuration, the multiple cylinders may drive a single crankshaft or a plurality of crankshafts. Typically 'flat', 'straight', 'V' and radial configurations will have a single crankshaft, whereas 'U' and 'W' configurations will have two crankshafts, one for each bank of cylinders, although some embodiments of 'U' and 'W' configurations may be configured to drive a single crankshaft via articulated rods.

BRIEF DESCRIPTION OF THE DRAWINGS

An embodiment of the invention is now described by way of example, with reference to the accompanying drawings in which:

FIG. 1 is a cross-section through a flat four engine configuration according to an embodiment of the present invention;

FIG. 2 is a cross-section of the engine of FIG. 1 along line z-z in FIG. 1;

FIG. 3 is a cross-section of the engine of FIGS. 1 and 2 along the centre line of the uppermost opposed pair of cylinders as shown in FIG. 2;

FIGS. 4(*a*) to 4(*m*) show snapshots of the engine of FIG. 1 (in a simplified form) through one complete revolution of the crankshaft at 0°, 30°, 60°, 90°, 120°, 150°, 180°, 210°, 240°, 272°, 300°, 330°, 360° respectively, starting from the point in the cycle of minimum combustion chamber volume (referred to in the following for convenience as 'top dead centre' or 'TDC'—this terminology (TDC) is used because the skilled person will recognise that is the analogous point in the operating cycle for a more conventionally disposed engine) of the cylinder seen in the bottom left of the figure;

FIG. 5 shows a cross-section, similar to that in FIG. 3, of an engine configuration in accordance with a second embodiment of the present invention;

FIG. 6 shows a cross-section, similar to that in FIG. 3, of an engine configuration in accordance with a third embodiment of the present invention;

FIG. 7 shows a cross-section, similar to that in FIG. 3, of an engine configuration in accordance with a fourth embodiment of the present invention;

FIG. 8 shows a cross-section, similar to that in FIG. 3, of an engine configuration in accordance with a fifth embodiment of the present invention; and FIG. 9 shows a cross-section, similar to that in FIG. 3, of an engine configuration in accordance with a sixth embodiment of the present invention.

DETAILED DESCRIPTION

The embodiment used here to exemplify the invention is a 2-stroke, indirect injection, four cylinder, spark ignited engine. The engine is configured with two horizontally opposed pairs of cylinders. One pair of cylinders is arranged alongside the other to give a 'flat four' configuration. This configuration provides the engine with a low-profile overall envelope that will be advantageous for some applications, for example for use as an outboard marine engine. Engines in accordance with embodiments of the invention can also be used as propulsion or power generation units for other marine applications, as well as for land vehicles and aircraft.

In more detail, looking initially at FIGS. 1 to 3, the engine 10 comprises four cylinders 12 arranged about a central crankshaft 14, mounted for rotation about axis z-z (see FIG. 1). The two cylinders, one either side of the crankshaft, to the bottom of FIG. 1 are one opposed pair of cylinders and the two other cylinders, towards the top of FIG. 1 are the other pair of opposed cylinders.

Within each cylinder there are two pistons, an inner piston 16 and an outer piston 18. The two pistons in each cylinder are opposed to one another and reciprocate in opposite directions, in this example 180 degrees out of phase.

Each piston has a crown 20, 22, the crowns of the two pistons facing one another, and a skirt 24, 26 depending from the crown. In this example, the crowns 24, 26 are both shaped as shallow bowls. At top dead centre, when the piston crowns are closest to one another (and very nearly touching), the opposed crowns 24, 26 define a combustion chamber 28 in which a fuel air mixture, previously introduced into the combustion chamber, is spark ignited and combusts to provide the power stroke of the cycle.

As explained in more detail further below, when the pistons are at a position in their cycle where they are spaced furthest from one another to define a maximum contained volume within the cylinder ("bottom dead centre"), as seen for the top left and bottom right cylinders in FIG. 1, the piston crowns are withdrawn sufficiently far to uncover intake ports 30 and exhaust ports 32, towards the inner and outer ends of the cylinder respectively. As the pistons 16, 18 move towards one another in the compression stroke of the cycle, the piston skirts cover and close the ports, the skirt 24 of the inner piston 16 closing the intake port 30 and the skirt 26 of the outer piston 18 closing the exhaust port 32. As best seen in FIGS. 1 and 2, the exhaust ports 32 have a greater axial extent (i.e. dimension in the direction of the longitudinal axis of the cylinder) than the intake ports so that the exhaust ports open sooner than and stay open longer than the intake ports, to aid scavenging of the cylinder.

Associated with each cylinder 12 is a fuel injector 34. In this indirect injection example, the fuel injector is mounted on the side of the cylinder 12 and injects fuel into an annular intake manifold 35 that surrounds the cylinder wall adjacent the intake ports 30. As seen in this example, the injectors may be positioned to inject fuel directly through the intake port 30 when these ports are uncovered by the inner piston 16. Fuel is supplied to the injector 34 in a conventional manner.

A standard injector and fuel rail arrangement can be used. In some embodiments, multiple injectors (e.g. two, or three or more injectors) may be used for each cylinder. When multiple injectors are used they may be spaced (preferably substantially equally spaced) circumferentially around the cylinder.

In accordance with the invention, each cylinder 12 also has a spark plug assembly 36, including a housing 37 and a spark plug 38 mounted within the housing 37, with electrodes 39 of the spark plug exposed at one end of the housing 37 within the combustion chamber 28. In this example, the spark plug 38 is mounted along the central axis of the cylinder 12, within the housing 37, to which it is fixed. An outer end of the housing 37 is fixed to a component 40 at the outer end of the cylinder (i.e. the end of the cylinder opposite the crankshaft 14). The spark plug assembly 36 extends through a central opening 42 in the outer piston crown 22 to locate the inner end of the spark plug 38, i.e. the end at which the electrodes 39 are located, centrally in the cylinder 12. More specifically, as seen in the bottom left and top right cylinders in FIG. 2 and the left hand cylinder in FIG. 1, when the pistons 16, 18 are at top dead centre, the electrodes 39 of the spark plug 38 is directly within the combustion chamber 28.

In the central spark plug arrangement described here the spark plug assembly 36 is fixed in position and, during operation of the engine 10, the outer piston 18 travels along the outside of the spark plug housing 37. Appropriate seals (not shown) are provided around the periphery of the opening 42 in the outer piston crown 22 to maintain a seal between the piston crown 22 and the spark plug housing 37 as the piston 18 reciprocates back and forth along the housing 37, to avoid or at least minimise leakage of pressurised gases from within the cylinder and to prevent ingress of oil to the combustion chamber. The outer surface of the spark plug housing 37 is configured to allow sliding contact with the piston 18. The spark plug 38 may be surrounded by a coolant within the housing 37, although this may not be required in some embodiments.

The spark plugs 38 themselves can be of conventional construction. They may be powered by a conventional coil.

Although in this example the spark plug assembly 36 projects from the outer end of the cylinder through the outer piston, in other embodiments it may project from the inner end of the cylinder through the inner piston (with the inner piston sliding on the spark plug housing 37).

In this example, the pistons 16, 18 drive the crankshaft 14 through four scotch yoke arrangements 50, 52, 54, 56, mounted on respective eccentrics 58 on the crankshaft 14. The scotch yokes are shared by multiple pistons to minimise the number of scotch yokes that are required and hence to minimise a required length of the crankshaft providing a more compact design.

The scotch yoke arrangement may be as described in co-pending UK patent applications nos. GB1108766.4 and GB1108767.3, the entire contents of which are incorporated herein by reference. Specific reference is made to FIGS. 5 & 6 of these earlier applications, and the description associated with these figures, for an explanation of the preferred scotch yoke arrangement.

Operation of the Engine

FIG. 4 illustrates the operation of the engine of FIGS. 1 to 3 over one complete crankshaft rotation. Specifically, FIGS. 4(*a*) to 4(*m*) illustrate the piston positions at 30° increments.

FIG. 4(*a*) at 0° ADC shows the engine at a crankshaft position of 0° (arbitrarily defined as TDC in the bottom left cylinder 12 of FIG. 1). At this position, the bottom left outer piston 18*c* and the bottom left inner piston 16*c* are at their point of closest approach. At this angle of crankshaft rotation, in the exemplified indirect-injection engine, combustion would be underway, having been initiated by the spark from around 10° to 40° before TDC dependent on engine operating parameters including engine speed and load. At this point, the exhaust and intake ports 32, 30 of the bottom left cylinder are completely closed by outer and inner pistons respectively.

In FIG. 4(*b*) at 30° ADC, the inner and outer pistons of the bottom left cylinder are moving apart at the beginning of the power stroke.

In FIG. 4(*c*) at 60° ADC, the bottom left cylinder continues its power stroke, with the two pistons equal but opposite velocities.

In FIG. 4(*d*) at 90° ADC, the bottom left cylinder continues its power stroke.

In FIG. 4(*e*) at 120° ADC, the outer piston of the bottom left cylinder has opened exhaust ports 32, while the intake ports remain closed. In this "blowdown" condition, some of the kinetic energy of the expanding gases from the combustion chamber can be recovered externally if desired by a turbocharger ("pulse" turbocharging) e.g. for compressing the next.

In FIG. 4(*f*) at 150° ADC, the inner piston of the bottom left cylinder has opened the intake ports 30 and the cylinder is being uniflow scavenged.

In FIG. 4(*g*) at 180° ADC, the inner and outer pistons of the bottom left cylinder are causing both intake and exhaust ports 30, 32 to remain open and uniflow scavenging continues. The pistons are at bottom dead centre.

In FIG. 4(*h*) at 210° ADC, in the bottom left cylinder, both sets of ports 30, 32 remain open and uniflow scavenging continues. Fuel is injected from the injector in the inlet manifold, and carried into the cylinder through an intake port adjacent the injector.

In FIG. 4(*i*) at 240° ADC, in the bottom left cylinder, the inner piston has closed the intake ports 30, while the exhaust ports 32 remain partially open. In other embodiments the exhaust port may open after and/or close before the inlet port opens/closes. Preferably, the port geometry is also designed to assist good scavenging without the new charge passing through the cylinder into the exhaust. It may also be desirable in some applications for the port timing to be asymmetric, with the exhaust port being closed earlier than in the illustrated example, for example by using a sleeve valve to control the opening and closing of the ports. Good scavenging can also be encourage by appropriate control and adjustment of the intake boost.

In FIG. 4(*j*) at 270° ADC, in the bottom left cylinder, the outer piston has closed the exhaust ports 32 and the two pistons are moving towards each other, compressing the fuel air mixture between them.

In FIG. 4(*k*) at 300° ADC, in the bottom left cylinder, the pistons continue the compression stroke.

In FIG. 4(*l*) at 330° ADC, the bottom left cylinder is nearing the end of the compression stroke.

In FIG. 4(*m*) at 360° ADC, the position is the same as in FIG. 3(*a*). The bottom left cylinder has reached the TDC position, where the pistons are at their position of closest approach.

The specific angles and timings depend on the crankshaft geometries and port sizes and locations; the above description is intended solely to illustrate the concepts of the invention. The timing of fuel injection into the intake manifold can be determined in a conventional manner based on the specific engine and its operating parameters.

Variants

FIGS. 5 to 9 illustrate further exemplary embodiments of the invention. Their operation is broadly similar to the embodiment described above. They differ from the embodiment described above in the configuration and location of the spark plug and/or the fuel injector, as explained below.

FIG. 5 shows another indirect-injection configuration. The fuel injectors 34 are configured and operate in the same way as they do in the embodiment of FIGS. 1 to 4. In this example, however, the spark plugs 38 are fixed to a move with the outer pistons 18. In an alternative embodiment, they can be fixed to and move with the inner piston 16.

To provide power to the spark plugs 38, a sliding electrical connector 60 is fixed to the outer end of the spark plug 38.

FIG. 6 shows the first of four direct-injection variants of the engine. In this example, the fuel injector 34 is in a fixed position in the wall of the cylinder 12. Multiple injectors may be spaced circumferentially around the cylinder if desired. The injector nozzle is exposed directly to the cylinder interior, in-line with the combustion chamber that is formed between the pistons when they are at their closest (as seen in the left-hand cylinder in FIG. 6). Fuel is injected directly into the cylinder at a predetermined point after the exhaust port closes and prior to TDC. The fuel air mixture is ignited by the spark plug 38. In this example, the spark plug configuration is the same as that described above for the embodiment of FIGS. 1 to 4.

FIG. 7 shows another direct-injection example. In this example, however, the fuel injector 34 is mounted alongside the spark plug 38 so that it extends from one end of the cylinder (the outer end in the illustrated example), coaxially with the cylinder. The injector 34 and the spark plug are mounted within the same housing 37 in this example and may be cooled by a coolant within this housing. Although the combined spark plug and injector assembly are shown associated with the outer piston in this example, in other embodiments the assembly can be project from the inner end of the cylinder through the inner piston.

The variant seen in FIG. 8 has a spark plug 38 that is fixed to and moves with the inner piston 16. Similarly to the variant seen in FIG. 5, a sliding electrical connector 60 is used to provide power to the spark plug 38. The fuel injectors 34 in this example are mounted centrally within the cylinder, in a fixed position, extending from the outer end of the cylinder through the outer piston 18. The outer piston 18 slides along a housing of the fuel injector. In this example, the nozzle of the fuel injector 34 therefore faces the electrodes of the spark plug 38 and they are closely opposed to one another when the pistons are at their closest (see left-hand cylinder in FIG. 8).

FIG. 9 shows a variant similar to that of FIG. 8 (the configuration of the spark plug 38 is the same) but in this example, rather than being fixed in position within the cylinder, the fuel injector 34 is fixed to and moves with the outer piston 18. As with the example of FIG. 8, when the pistons are in a position in which they are closest to one another, the electrodes of the spark plug and the nozzle of the injector are closely opposed to one another on the centre line of the cylinder (as seen in the left-hand cylinder in FIG. 9). In another embodiment, the positions of the fuel injector 34 and spark plug 38 may be reversed, with the spark plug 38 moving with the outer piston 18 and the fuel injector moving with the inner piston 16.

FIGS. 5 to 9 show a few of a greater number of possible variants and features of these illustrated variants may be used together in other combinations that are not specifically illustrated. For instance, the moving spark plug arrangement of FIG. 8 may be used with the fixed direct-injector arrangement in the cylinder side wall, seen in FIG. 6, or the indirect injector arrangement seen in FIGS. 1 and 5. Other combinations are possible.

The skilled person will appreciate that various modification to the specifically described embodiment are possible without departing from the invention. For example, although the invention has been illustrated in the context of a 2-stroke spark ignited engine, the skilled person will also appreciate that embodiments of the invention may be 2-stroke or 4-stroke and may be spark ignited or spark assisted engine types.

The invention claimed is:

1. An internal combustion engine comprising:

at least one cylinder;

a pair of opposed, reciprocating pistons within the cylinder forming a combustion chamber therebetween, wherein the pair of opposed, reciprocating pistons comprise an inner piston and an outer piston, the outer piston having a crown with a central opening; and at least one combustion igniter associated with the cylinder, a portion of the combustion igniter being exposed within the combustion chamber formed between the opposed pistons, wherein the combustion igniter moves back and forth through the central opening in the crown of the outer piston as the outer piston reciprocates with respect to the fixed combustion igniter, wherein the combustion igniter is fixed at one end of the cylinder and projects into the cylinder from that end, along the central axis of the cylinder, to locate said portion of the combustion igniter in a fixed position that is within the combustion chamber throughout the engine cycle, wherein the combustion igniter extends through the outer piston, which is closest to the end of the cylinder from which the combustion igniter projects, and said outer piston is configured to reciprocate along a housing within which the combustion igniter is housed so that the outer piston reciprocates relative to the fixed position of the combustion igniter.

2. The internal combustion engine according to claim 1, wherein the combustion igniter is at or close to the central axis of the cylinder/piston.

3. The internal combustion engine according to claim 1, comprising one or more fuel injectors for injecting fuel indirectly into the cylinder through an intake manifold for the cylinder.

4. The internal combustion engine according to claim 1, comprising at least one fuel injector having a nozzle that is directly exposed to the combustion chamber in the cylinder for injecting fuel directly into the cylinder.

5. The internal combustion engine according to claim 4, wherein said at least one fuel injector is mounted to a side wall of the cylinder.

6. The internal combustion engine according to claim 4, wherein said at least one fuel injector is mounted at an end of the cylinder with the injector nozzle protruding through a respective piston crown at said one end of the cylinder into the combustion chamber.

7. The internal combustion engine according to claim 6, wherein said at least one fuel injector is fixed in position within the cylinder with the piston sliding along a housing of the fuel injector.

8. The internal combustion engine according to claim 6, wherein said at least one fuel injector is fixed to and moves with the piston as the piston reciprocates within the cylinder.

9. The internal combustion engine according claim 6, wherein the fuel injector and the combustion igniter project from opposite ends of the cylinder.

10. The internal combustion engine according claim 6, wherein the fuel injector and the combustion igniter project from the same end of the cylinder.

11. The internal combustion engine according to claim 10, wherein the fuel injector and the combustion igniter are contained within a single housing.

12. The internal combustion engine according to claim 1, comprising multiple cylinders.

13. The internal combustion engine according to claim 12, comprising at least two coaxially opposed cylinders, each cylinder having a pair of opposed pistons and all of the pistons driving a single crankshaft located between the two cylinders.

14. The internal combustion engine according to claim 13, comprising two pairs of coaxially opposed cylinders, the pairs of cylinders arranged adjacent one another in a flat four configuration, each cylinder having a pair of opposed pistons and all of the pistons driving a single crankshaft located between the two cylinders of each pair.

15. An internal combustion engine comprising:

at least one cylinder;

a pair of opposed, reciprocating pistons within the cylinder forming a combustion chamber therebetween, wherein the pair of opposed, reciprocating pistons comprise an inner piston and an outer piston, the outer piston having a crown with a central opening; and at least one combustion igniter associated with the cylinder, a portion of the combustion igniter being exposed within the combustion chamber formed between the opposed pistons, wherein the combustion igniter moves back and forth through the central opening in the crown of the outer piston as the outer piston reciprocates with respect to the fixed combustion igniter, wherein the combustion igniter is fixed at one end of the cylinder and projects into the cylinder from that end, parallel to the central axis of the cylinder, to locate said portion of the combustion igniter in a fixed position that is within the combustion chamber throughout the engine cycle, wherein the combustion igniter extends through the outer piston, which is closest to the end of the cylinder from which the combustion igniter projects, and said outer piston is configured to reciprocate along a housing within which the combustion igniter is housed so that the outer piston reciprocates relative to the fixed position of the combustion igniter.

16. The internal combustion engine according to claim 15, wherein the combustion igniter is at or close to the central axis of the cylinder/piston.

17. The internal combustion engine according to claim 15, comprising one or more fuel injectors for injecting fuel indirectly into the cylinder through an intake manifold for the cylinder.

18. The internal combustion engine according to claim 15, comprising at least one fuel injector having a nozzle that is directly exposed to the combustion chamber in the cylinder for injecting fuel directly into the cylinder.

19. The internal combustion engine according to claim 18, wherein said at least one fuel injector is mounted to a side wall of the cylinder.

20. The internal combustion engine according to claim 18, wherein said at least one fuel injector is mounted at an end of the cylinder with the injector nozzle protruding through a respective piston crown at said one end of the cylinder into the combustion chamber.

21. The internal combustion engine according to claim 20, wherein said at least one fuel injector is fixed in position within the cylinder with the piston sliding along a housing of the fuel injector.

22. The internal combustion engine according to claim 20, wherein said at least one fuel injector is fixed to and moves with the piston as the piston reciprocates within the cylinder.

23. The internal combustion engine according claim 20, wherein the fuel injector and the combustion igniter project from opposite ends of the cylinder.

24. The internal combustion engine according claim 20, wherein the fuel injector and the combustion igniter project from the same end of the cylinder.

25. The internal combustion engine according to claim 24, wherein the fuel injector and the combustion igniter are contained within a single housing.

26. The internal combustion engine according to claim 15, comprising multiple cylinders.

27. The internal combustion engine according to claim 26, comprising at least two coaxially opposed cylinders, each cylinder having a pair of opposed pistons and all of the pistons driving a single crankshaft located between the two cylinders.

28. The internal combustion engine according to claim 27, comprising two pairs of coaxially opposed cylinders, the pairs of cylinders arranged adjacent one another in a flat four configuration, each cylinder having a pair of opposed pistons and all of the pistons driving a single crankshaft located between the two cylinders of each pair.

* * * * *